US005117714A

United States Patent [19]

Pagac et al.

[11] Patent Number: 5,117,714

[45] Date of Patent: Jun. 2, 1992

[54] ONE-PIECE, OPEN-END WRENCHING HEAD WITH SERRATED JAWS

[75] Inventors: William T. Pagac; Frank Mikic; Thomas S. Severson, all of Kenosha; Douglas M. Sorbie, Salem, all of Wis.

[73] Assignee: Snap-on Tools Corporation, Kenosha, Wis.

[21] Appl. No.: 487,921

[22] Filed: Mar. 5, 1990

Related U.S. Application Data

[63] Continuation-in-part of Ser. No. 421,669, Oct. 16, 1989, abandoned.

[51] Int. Cl.[5] ..... B25B 13/02

[52] U.S. Cl. ..... 81/119; 81/121.1

[58] Field of Search ..... 81/119, 121, 122, 125.1

[56] References Cited

U.S. PATENT DOCUMENTS 2,777,348 1/1957 Wraight ..... 81/119

4,126,063 11/1978 Palmer ..... 81/121

FOREIGN PATENT DOCUMENTS 1309258 10/1962 France ..... 81/119

0508761 7/1939 United Kingdom .

*Primary Examiner*—James G. Smith

*Assistant Examiner*—Lawrence Cruz

*Attorney, Agent, or Firm*—Emrich & Dithmar

[57] ABSTRACT

The open-end wrenching head includes two jaws and a throat interconnecting the jaws. The jaws include planar jaw driving surfaces each with at least one serrated region thereon constructed and arranged to engage a portion of a selected side of a fastener. The throat may include either an arcuate surface or two planar throat driving surfaces having serrated regions thereon. Each of the serrated regions on the driving surfaces may include symmetrical or asymmetrical grooves. The plane of these grooves may be parallel to the driving surfaces or at an angle of about 1° to 3°.

39 Claims, 2 Drawing Sheets

A
53
52
53
18
42
A
49
50
30
32
38
28
24
48
51
34
B
32
43

14
10
12
16

12
16
22
29
27
29a
45
36
26a
26
26b
20
43
34
24
42
38
18
24a
24b
25
44
40
28
30
32
30

ONE-PIECE, OPEN-END WRENCHING HEAD WITH SERRATED JAWS

CROSS-REFERENCE TO RELATED APPLICATION

This is a continuation-in-part of Applicants' application, Ser. No. 421,669, now abandoned, filed Oct. 16, 1989, and entitled "One-piece, Open-end Wrenching Head with Serrated Jaws," the disclosure of which is incorporated herein by reference.

BACKGROUND OF THE INVENTION

This invention relates generally to open-end wrenches and specifically to such a wrench including a wrenching head with driving surfaces having serrated regions thereon.

A typical open-end wrench consists of an elongated handle and a wrenching head on either or both ends, the head including two jaws each with smooth planar driving surfaces that engage opposite sides of a polygonal fastener.

A disadvantage of such a wrench is the inadequate gripping force between the driving surfaces and the fastener. As a result, the wrench has a tendency to slip off the fastener when torque is applied thereto. That could be dangerous. Also, it increases stress in the fastener, tends to deform and spread the wrench jaws, and rounds and/or crushes the fastener corners.

SUMMARY OF THE INVENTION

It is a general object of the present invention to provide an improved open-end wrench which avoids the disadvantages of prior wrenches while affording additional structural and operating advantages.

Another object is to provide strong gripping force between the driving surfaces of the wrench and the surfaces of the fastener, thereby reducing the tendency of the wrench to slip off the fastener when torque is applied thereto.

Another object is to reduce the stress on the fastener, the deformation and spreading of the jaws of an open-end wrench and the rounding and/or crushing of the fastener corners.

Another object is to preclude contact of the wrench driving surfaces with the corners of the fastener, thereby reducing any rounding and/or crushing of the fastener corners.

In summary, there is provided a one-piece, open-end wrenching head for a fastener having a plurality of generally flat sides intersecting at a plurality of corners, the fastener having an across-sides dimension, the wrenching head comprising two jaws and a throat integrally interconnecting the jaws, the jaws including jaw driving surfaces spaced apart a distance slightly greater than the across-sides dimension of the fastener, each of the jaw driving surfaces having an outer end at a distance from the deepest point of the throat of 0.866 times the predetermined distance, at least one of the jaw driving surfaces having at least one serrated region thereon constructed and arranged to engage a portion of a side of the fastener.

The invention consists of these and other features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purposes of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
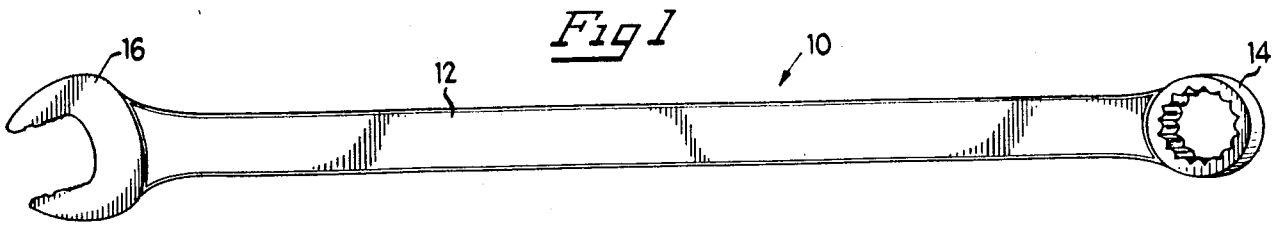
FIG. 1 is a perspective view of an open-end wrench incorporating a preferred embodiment of the present invention.
Figure 2:
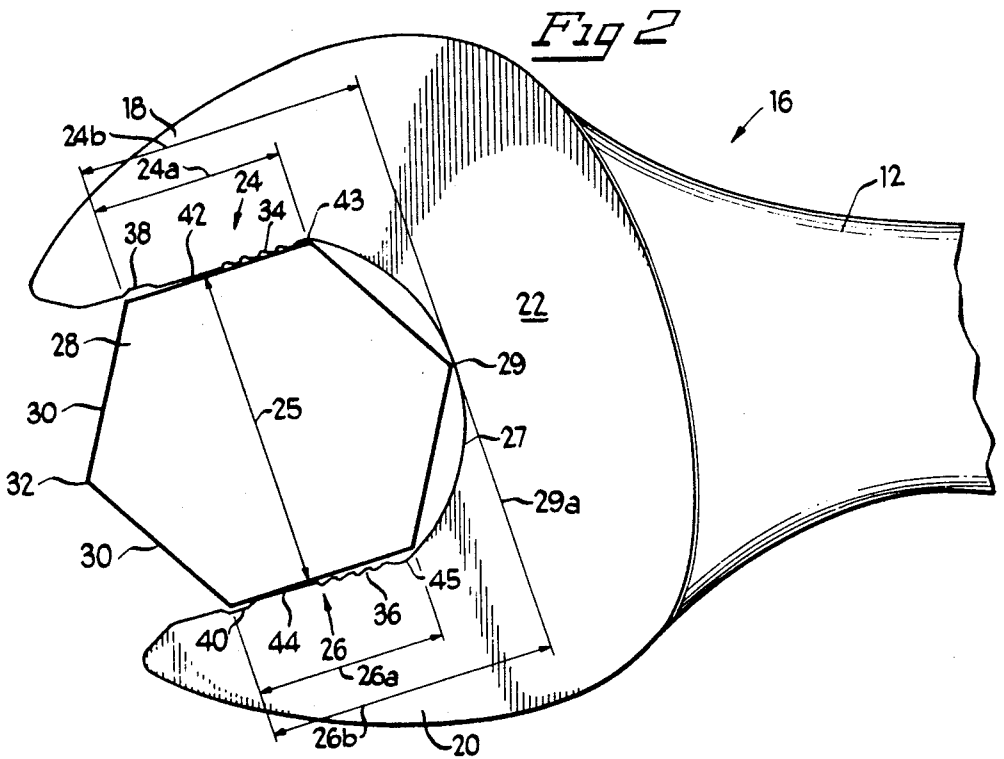
FIG. 2 is an enlarged, fragmentary view of the wrenching head of the open-end wrench shown in FIG. 1, having a fastener located therein.

Referring now to the drawings, and more particularly to FIG. 1 thereof, there is depicted a one-piece, open-end wrench 10, which comprises an elongated handle 12 and one-piece, open-end wrenching heads 14 and 16. In this description, the term "open-end wrenching head" includes the heads of such tools as so-called "flare-nut" wrenches and "ratcheting open-end" wrenches. As shown in FIG. 2, the wrenching head 16 includes two jaws 18 and 20 and a throat 22. The jaws 18 and 20, respectively, include jaw driving surfaces 24 and 26. The throat 22 includes an arcuate surface 27 which interconnects surfaces 24 and 26. An arcuate throat has reduced stress concentration as compared to a V-shaped throat. A fastener 28 having a plurality of generally flat sides 30 intersecting in a plurality of corners 32 is located between surfaces 24 and 26. A corner of the fastener 28 contacts the deepest point 29 of surface 27. Surfaces 24 and 26 are spaced apart a distance 25 slightly greater than the across-sides dimension of the fastener 28 such that surfaces 24 and 26 simultaneously engage opposite sides 30 of the fastener 28.

Surface 24 has a serrated region 34 near one end thereof, an unserrated, generally planar region 42 and a relief region 38 near the other end. Surface 24 also has an arcuate relief region 43 at the intersection with the throat surface 27. Surface 24 extends from the adjacent end of arcuate surface 27 of throat 22 a distance **24*a* substantially equal to the length of a side 30 of fastener 28. It is important that serrated region 34 be located on surface 24 in order to be certain that such serrated region will necessarily engage the fastener when it is seated in wrench head 16. The length or distance 24***a* is 0.578 times the distance 25 between surfaces 24 and 26. This factor is based on the fact that the side of a hexagonal fastener is inherently equal to 0.578 times the across-sides dimension of such fastener. The outer end of surface 24 is a distance 24*b* from an imaginary line 29*a* which passes through the deepest point 29 of throat surface 27 and is substantially perpendicular to the surfaces 24 and 26. Based on the inherent configuration of a hexagonal fastener, the distance 24*b* is 0.866 times the distance 25 between surfaces 24 and 26. In the embodiment of FIG. 2, serrated region 34 is on that portion of surface 24 nearest surface 27.

Similarly, surface 26 has a serrated region 36, an unserrated region 44 and a relief region 40. Surface 26 has an arcuate relief region 45 at the intersection with the throat surface 27. Surface 26 extends from the adjacent end of arcuate surface 27 of throat 22 a distance 26*a*. The outer end of surface 26 is a distance 26*b* from line 29*a*. It is important that serrated region 36 be located on surface 26 in order to be certain that such serrated region will necessarily engage that fastener while it is seated in wrench head 16. Again, the length or distance 26*a* is 0.578 times the distance 25 between surfaces 24 and 26, and the distance 26*b* is 0.866 times distance 25. In this embodiment, serrated region 36 is on that portion of surface 26 nearest throat surface 27.

Figure 3:
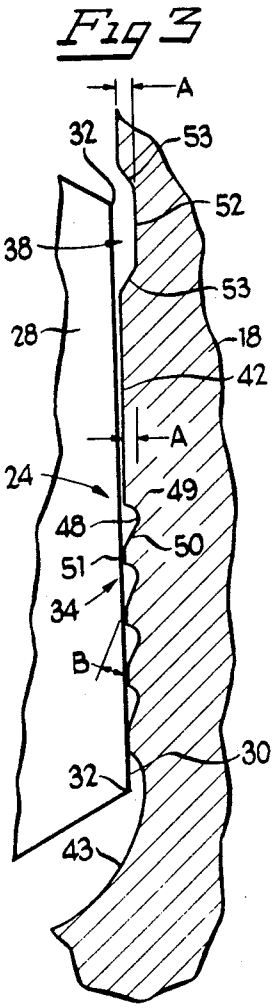
FIG. 3 is a greatly enlarged, fragmentary view of a portion of one of the jaws of the open-end wrenching head of FIGS. 1 and 2, together with an adjacent portion of the fastener.

Referring to FIG. 3, the serrated region 34 includes a plurality of asymmetrical grooves 48 which extend a depth A into surface 24. Each groove 48 has a curved segment 49 and a substantially straight segment 50, the latter being at an angle B with respect to the surface 24. Between adjacent grooves 48 are lands 51. In an operative embodiment, the depth A is on the order of 0.006 inch for a wrenching head used on a fastener having an across-sides dimension of 0.5 inch or less, and on the order of 0.01 inch for a 1 inch head. The angle B was 20°.

The jaw relief region 38, in the particular embodiment depicted, includes a substantially planar bottom surface 52 extending a depth A into surface 24 and diverging side walls 53. The relief region 38 receives a corner 32 of the fastener 28 during counterclockwise rotation of the wrench, and this prevents such corner from engaging surface 24, thereby preventing rounding and crushing of such corner.

The serrated region 36 and the relief region 40 of surface 26 are identical in structure respectively to the serrated region 34 and the relief region 38 of surface 24, described in FIG. 3.

When the wrenching head 16 is rotated in the clockwise direction, initially there will be 1° or 2° of "free" swing or rotation because surfaces 24 and 26 do not engage the fastener sides 30. Upon further rotation, one or more of the lands 51 (FIG. 3) of the serrated region 34 will engage the adjacent portion of the fastener side to provide a gripping action. The unserrated, generally planar region 44 on surface 26 engages the opposite portion of the opposite fastener side. The relief regions 40 and 43 receive opposite fastener corners, so that such corners are not contacted and thus not damaged.

When the wrenching head 16 is rotated in the counterclockwise direction, one or more of the lands of the serrated region 36 on surface 26 engages the adjacent fastener side 30, while the unserrated region 42 on surface 24 will engage the opposite fastener side. The relief regions 38 and 45 receive opposite fastener corners to minimize damage to them.

Figure 4:
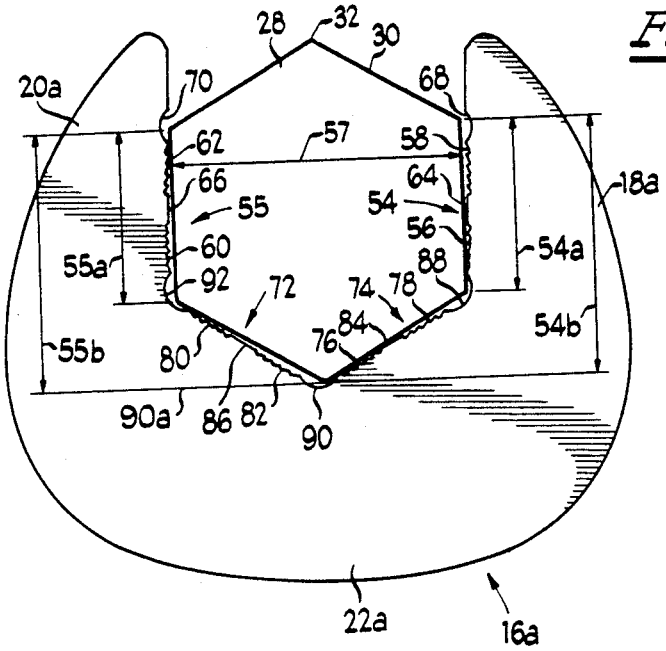
FIG. 4 is an enlarged, fragmentary view of an open-end wrenching head incorporating a second embodiment of the present invention.

FIG. 4 shows a wrenching head 16*a*, which includes jaws 18*a* and 20*a* and a throat 22*a*. The jaws 18*a* and 20*a* respectively have jaw driving surfaces 54 and 55. Surfaces 54 and 55 are spaced apart a distance 57 slightly greater than the across-sides dimension of fastener 28. For the same reasons explained above with respect to the embodiment of FIG. 2, surfaces 54 and 55 respectively have lengths 54*a* and 55*a* equal to 0.578 times the distance 57 between surfaces 54 and 55.

The outer ends of surfaces 54 and 55 are distances 54*b* and 55*b*, respectively, from an imaginary line 90*a* which passes through the deepest point 90 of the throat defined generally by the intersection of surfaces 72 and 74 and is substantially perpendicular to the surfaces 54 and 55. Based on the inherent configuration of a hexagonal fastener, the distances 54*b* and 55*b* are 0.866 times distance 57. The surface 54 has a pair of serrated regions 56 and 58, and the surface 55 has a pair of serrated regions 60 and 62. Each of the serrated regions 56, 58, 60 and 62 has a plurality of unidirectional, asymmetrical grooves like those depicted in FIG. 3. The grooves in the region 56 are oriented in a direction opposite to the grooves in the region 58 to assure a maximum gripping force irrespective of the direction in which the wrenching head 16 is rotated. The grooves in the regions 60 and 62 are likewise oppositely directed. A planar land 64 is between the serrated regions 56 and 58, and a planar land 66 is between the serrated regions 60 and 62.

The jaw driving surfaces 54 and 55, respectively include semicircular jaw relief regions 68 and 70. The regions 68 and 70 receive the corners 32 of the fastener 28 so that they do not contact the jaw driving surfaces 54 and 55 upon rotation of the wrench.

The throat 22*a* has planar throat driving surfaces 72 and 74, each at a preferred angle of 120° to the adjacent jaw driving surfaces 54 and 55. Surfaces 72 and 74 each have a length of approximately 0.578 times distance 57. The throat driving surface 74 has a pair of serrated regions 76 and 78 interconnected by a planar land 84 while the throat driving surface 72 has a pair of serrated regions 80 and 82 interconnected by a planar land 86.

Each of the serrated regions 76, 78, 80 and 82 has a plurality of unidirectional, asymmetrical grooves like those depicted in FIG. 3. A relief region 88 is between surfaces 54 and 74, a relief region 90 is between surfaces 72 and 74, and a relief region 92 is between 55 and 72. Each of the relief regions 88, 90 and 92 has a semicircular surface. The relief regions 68, 70, 88, 90 and 92 receive fastener corners, and thereby prevent them from contacting the jaw driving surfaces 54 and 55 and the throat driving surfaces 72 and 74 upon rotation of the wrench.

In order to use a wrench incorporating the head 16*a* of FIG. 4 to tighten a fastener, it is rotated clockwise 1° to 2° of "free" swing. Four sides of the fastener are respectively engaged by one or more flats of the serrated regions 56, 62, 76 and 80, to tightly grip the fastener and thereby minimize the chance of the wrench from slipping of the fastener sides and thereby maximize the amount of torque which can be applied. If the wrenching head 16*a* is rotated in the counterclockwise direction, the four fastener sides are engaged by one or more flats of the serrated regions 60, 82, 78 and 58. Whether rotated in either direction corners of the fastener are received in the relief regions 68, 88, 90, 92 and 70 to prevent damage to such corners.

Figure 5:
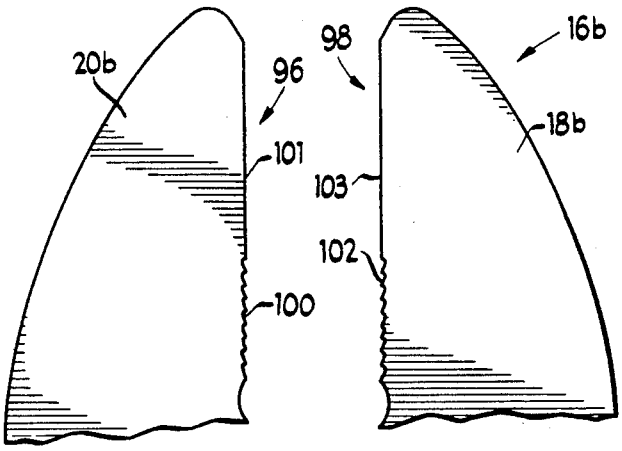
FIG. 5 is an enlarged, fragmentary view of the jaws of an open-end wrenching head incorporating a third embodiment of the present invention.

A wrenching head 16*b* is shown in FIG. 5 and includes jaws 18*b* and 20*b* respectively having jaw driving surfaces 96 and 98. The jaw driving surface 96 has a serrated region 100 and an unserrated, generally planar region 101. The jaw driving surface 98 has a serrated region 102 and an unserrated region 103. The unserrated, generally planar regions 101 and 103 are laterally aligned and the serrated regions 100 and 102 are laterally aligned. The throat connecting the jaws **18*b* and 20*b* may be arcuate as in FIG. 2 or V-shaped as in FIG. 4. The jaw driving surfaces 96 and 98** have no relief regions.

Figure 6:
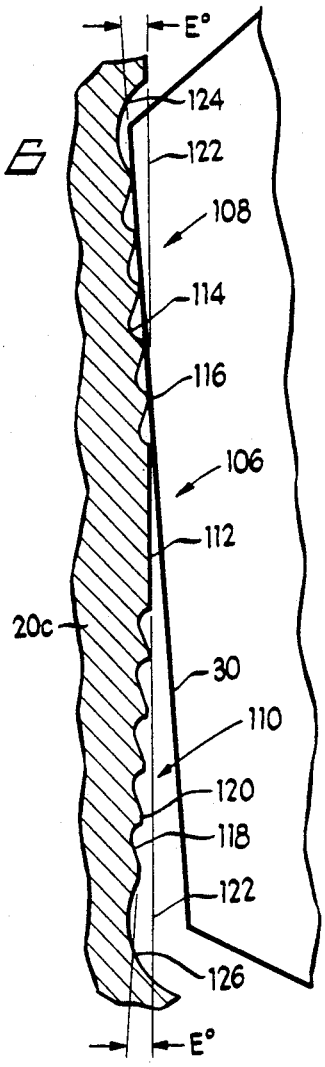
FIG. 6 is a greatly enlarged, fragmentary view of a portion of the jaws of an open-end wrenching head incorporating a fourth embodiment of the invention, together with an adjacent portion of the fastener.

Depicted in FIG. 6 is a jaw **20*c* including a jaw driving surface 106 having serrated regions 108 and 110 separated by a planar land 112. The serrated region 108 includes a plurality of grooves 114 alternating with a plurality of lands 116. The serrated region 110 includes a plurality of grooves 118 alternating with a plurality of lands 120. The grooves 114 and 118 are asymmetric, as shown in FIG. 3**.

The land 112 defines the jaw driving surface of the jaw **20*c* and lies in a plane 122. The serrated regions 108 and 110 are at an angle E to the plane 122. Specifically, the angle between a plane defined by the lands 116 and the plane 122 is $-E°$. Similarly, the angle between a plane defined by the lands 120 and the plane 122** is $+E°$. The angle E is 1° to 3°. In an actual embodiment of the invention, the angle E was 2°.

The inclination of the serrated regions 108 and 110 provides surface-to-surface contact between the lands 116 or 120, as the case may be, and the sides 30 of the fastener 28. Without such angular orientation, rotation of the wrenching head, of which the jaw **20*c* is part, will result in fewer than all of the flats of one of the serrated regions 108 and 110 contacting the sides of the fastener as a result of the non-parallelism between such sides 30 and the jaw driving surfaces. The angular orientation of the serrated regions 108 and 110 increases parallelism between such serrated regions and the fastener sides such that upon clockwise rotation of the wrenching head, more (or all) of the lands 116 engage the fastener sides 30 to achieve maximum gripping force and thereby minimize slipping of the wrench. Counterclockwise rotation results in the lands 120** engaging the fastener sides.

At the end of the serrated regions 108 and 110 are relief regions 124 and 126 to receive corners of the fastener so that the jaw **20*c* does not contact such corners during tightening (relief region 124) and loosening (relief region 126**).

Figure 7:
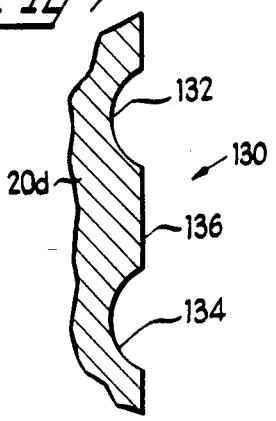
FIG. 7 is a greatly enlarged, fragmentary view of a portion of the jaws of an open-end wrenching head incorporating a fifth embodiment of the invention.

FIG. 7 shows a portion of a jaw **20*d* having a serrated region 130 including two symmetrical grooves 132 and 134 and a generally planar land 136 in between. The grooves 132 and 134** being semicircular, are easier to make.

An open-end wrench constructed in accordance with the present invention has one alternative from each of four different aspects: a throat which is either arcuate or V shaped, jaw surfaces which are either parallel or inclined at an angle such as 2°, grooves which are either symmetrical or asymmetrical and jaw surfaces which either have two serrated regions or a serrated region and an unserrated region. For example, the embodiment of FIGS. 1–3 includes an arcuate throat, parallel jaw surfaces, asymmetrical grooves and a jaw surface which includes a serrated region and an unserrated region. Sixteen different combinations are possible. For a further example, the throat driving surfaces in FIG. 4 can incorporate the two serrated regions as depicted or a serrated region and an unserrated region as depicted in FIG. 5. Also, any serrated region can incorporate asymmetrical grooves as depicted in FIG. 4 or the symmetrical grooves of FIG. 7.

From the foregoing, it can be seen that there has been provided an improved, open-end wrench including a wrenching head with jaw and/or throat driving surfaces having serrated regions which amplify the gripping action between the sides of the fastener and the driving surfaces of the wrenching head and, therefore, increase the amount of torque which can be applied without wrench slippage. In certain embodiments, one or more relief regions avoid contact with the corners of the fastener.

What is claimed is:

1. A one-piece, open-end wrenching head for a fastener having a plurality of generally flat sides intersecting at a plurality of corners, the fastener having an across-sides dimension, said wrenching head comprising two jaws and a throat integrally interconnecting said jaws, said jaws including jaw driving surface portions spaced apart a predetermined distance slightly greater than the across-sides dimension of said fastener, the outermost end of each of said jaw driving surface portions being at a distance from the deepest point of said throat of 0.866 times the predetermined distance, at least one of said jaw driving surface portions having at least one serrated region thereon constructed and arranged to engage a portion of a side of the fastener.

2. The wrenching head of claim 1, wherein said throat is arcuate.

3. The wrenching head of claim 1, wherein said throat includes two planar throat driving surfaces adapted to simultaneously engage selected adjacent sides of the fastener.

4. The wrenching head of claim 1, wherein said head further includes two relief regions respectively located between said jaw driving surface portions and said throat.

5. The wrenching head of claim 1, wherein each of said serrated regions has a plurality of asymmetrical grooves.

6. The wrenching head of claim 1, wherein each of said serrated regions has a plurality of symmetrical grooves.

7. The wrenching head of claim 1, wherein each of said jaw driving surface portions has at least one serrated region thereon.

8. The wrenching head of claim 1, wherein said head further includes a jaw relief region on each of said jaw driving surface portions to receive corners of the fastener.

9. The wrenching head of claim 1, wherein each of said jaw driving surface portions has two serrated regions.

10. The wrenching head of claim 1, wherein a plane defined by each jaw driving surface portion is at an angle of about 1° to 3° to a plane defined by the serrated region associated with each jaw driving surface portion.

11. The wrenching head of claim 1, wherein said throat includes an arcuate surface, said serrated region includes a plurality of symmetrical grooves alternating with a plurality of lands, and said lands define a plane substantially parallel to the plane of the associated jaw driving surface portion.

12. The wrenching head of claim 1, wherein said throat includes an arcuate surface, said serrated region includes a plurality of symmetrical grooves alternating with a plurality of lands, said lands define a plane substantially parallel to the plane of the associated jaw driving surface portion and each of said jaw driving surface portions includes relief means to receive a corner of the fastener.

13. The wrenching head of claim 1, wherein said throat includes an arcuate surface, said serrated region includes a plurality of asymmetrical grooves alternating with a plurality of lands, and said lands define a plane substantially parallel to the plane of the associated jaw driving surface portion.

14. The wrenching head of claim 1, wherein said throat includes an arcuate surface, said serrated region includes a plurality of asymmetrical grooves alternating with a plurality of lands, said lands define a plane substantially parallel to the plane of the associated jaw driving surface portion, and each of said jaw driving surfaces portions including relief means to receive a corner of the fastener.

15. The wrenching head of claim 1, wherein said throat includes an arcuate surface, said serrated region includes a plurality of symmetrical grooves alternating with a plurality of lands, and said lands define a plane of about 1° to 3° to the plane of the associated jaw driving surface portion.

16. The wrenching head of claim 1, wherein said throat includes an arcuate surface, said serrated region includes a plurality of symmetrical grooves alternating with a plurality of lands, said lands define a plane of about 1° to 3° plane of the associated jaw driving surface portion, and each of said jaw driving surface portions including relief means to receive a corner of the fastener.

17. The wrenching head of claim 1, wherein said throat includes an arcuate surface, said serrated region includes a plurality of asymmetrical grooves alternating with a plurality of lands, and said lands define a plane of about 1° to 3° to the plane of the associated jaw driving surface.

18. The wrenching head of claim 1, wherein said throat includes an arcuate surface, said serrated region includes a plurality of asymmetrical grooves alternating with a plurality of lands, said lands define a plane of about 1° to 3° to the plane of the associated jaw driving surface portion, and each of said jaw driving surface portions including relief means to receive a corner of the fastener.

19. The wrenching head of claim 1, wherein said throat includes two planar throat driving surfaces adapted to simultaneously engage selected adjacent sides of the fastener, said serrated region includes a plurality of symmetrical grooves alternating with a plurality of lands, and said lands define a plane substantially parallel to the plane of the associated jaw driving surface portion.

20. The wrenching head of claim 1, wherein said throat includes two planar throat driving surfaces adapted to simultaneously engage selected adjacent sides of the fastener, said serrated region includes a plurality of symmetrical grooves alternating with a plurality of lands, said lands define a plane substantially parallel to the plane of the associated jaw driving surface portion, and each of said jaw driving surface portions including relief means to receive a corner of the fastener.

21. The wrenching head of claim 1, wherein said throat includes two planar throat driving surfaces adapted to simultaneously engage selected adjacent sides of the fastener, said serrated region includes a plurality of asymmetrical grooves alternating with a plurality of lands, and said lands define a plane substantially parallel to the plane of the associated jaw driving surface portion.

22. The wrenching head of claim 1, wherein said throat includes two planar throat driving surfaces adapted to simultaneously engage selected adjacent sides of the fastener, said serrated region includes a plurality of asymmetrical grooves alternating with a plurality of lands, said lands define a plane substantially parallel to the plane of the associated jaw driving surface portion, and each of said jaw driving surface portions including relief means to receive a corner of the fastener.

23. The wrenching head of claim 1, wherein said throat includes two planar throat driving surfaces adapted to simultaneously engage selected adjacent sides of the fastener, said serrated region includes a plurality of symmetrical grooves alternating with a plurality of lands, and said lands define a plane of about 1° to 3° to the plane of the associated jaw driving surface portion.

24. The wrenching head of claim 1, wherein said throat includes two planar throat driving surfaces adapted to simultaneously engage selected adjacent sides of the fastener, said serrated region includes a plurality of symmetrical grooves alternating with a plurality of lands, said lands define a plane of about 1° to 3° to the plane of the associated jaw driving surface portion, and each of said jaw driving surface portions including relief means to receive a corner of the fastener.

25. The wrenching head of claim 1, wherein said throat includes two planar throat driving surfaces adapted to simultaneously engage selected adjacent sides of the fastener, said serrated region includes a plurality of asymmetrical grooves alternating with a plurality of lands, and said lands define a plane of about 1° to 3° to the plane of the associated jaw driving surface portion.

26. The wrenching head of claim 1, wherein said throat includes two planar throat driving surfaces adapted to simultaneously engage selected adjacent sides of the fastener, said serrated region includes a plurality of asymmetrical grooves alternating with a plurality of lands, said lands define a plane of about 1° to 3° to the plane of the associated jaw driving surface portion, and each of said jaw driving surface portions including relief means to receive a corner of the fastener.

27. The wrenching head of claim 3, wherein each of said throat driving surfaces has at least one serrated region thereon constructed and arranged to engage a portion of another side of the fastener.

28. The wrenching head of claim 3, wherein each of said throat driving surfaces includes a pair of serrated regions thereon constructed and arranged so that one of said serrated regions engages a portion of one side of the fastener when the wrench is rotated in one direction and the other of said serrated regions engages a portion when the wrench is rotated in the opposite direction.

29. The wrenching head of claim 3, wherein each of said jaw driving surface portions includes a relief region to receive a corner of the fastener.

30. The wrenching head of claim 5, wherein the asymmetrical grooves of the two serrated regions on each of the jaw driving surface portions are oppositely directed.

31. The wrenching head of claim 9, wherein each of said serrated regions has a plurality of symmetrical grooves.

32. The wrenching head of claim 9, wherein each of said serrated regions has a plurality of asymmetrical grooves.

33. The wrenching head of claim 32, wherein the asymmetrical grooves of one of the serrated regions on each of the jaw driving surface portions are directed oppositely to the grooves of the other of the serrated regions on each of the jaw driving surface portions.

34. The wrenching head of claims 20, 21, 22, 23, 24, 25, wherein each of said throat driving surfaces has at least one serrated region thereon.

35. A wrench comprising a handle and a one-piece, open-end wrenching head for a fastener having a plurality of generally flat sides intersecting at a plurality of corners, the fastener having an across-sides dimension, said wrenching head comprising two jaws and a throat integrally interconnecting said jaws, said jaws including jaw driving surface portions spaced apart a predetermined distance slightly greater than the across-sides dimension of said fastener, the outermost end of each of said jaw driving surface portions being at a distance from the deepest point of said throat of 0.866 times the predetermined distance, at least one of said jaw driving surface portions having at least one serrated region thereon constructed and arranged to engage a portion of a side of the fastener.

36. The wrench of claim 35, wherein each of said jaw driving surface portions includes a relief region to receive a corner of the fastener.

37. The wrench of claim 35, wherein said head further includes two relief regions respectively on said jaw driving surface portions.

38. The wrench of claim 35, wherein each of said jaw driving surface portions has at least one serrated region thereon.

39. The wrench of claim 35, wherein said head further includes a jaw relief region on each of said jaw driving surface portions to receive a corner of the fastener.

* * * * *